US005597106A

United States Patent [19]

Hamano et al.

[11] Patent Number: 5,597,106

[45] Date of Patent: Jan. 28, 1997

[54] DRIVE DEVICE FOR A NAILING MACHINE

[75] Inventors: Terufumi Hamano; Michiaki Adachi; Kazuhiko Mashimo; Noboru Ishikawa; Nobuo Kishi, all of Tokyo, Japan

[73] Assignee: Max Co., Ltd., Tokyo, Japan

[21] Appl. No.: 387,429

[22] Filed: Feb. 10, 1995

[30] Foreign Application Priority Data

Feb. 28, 1994 [JP] Japan ..... 6-055179

[51] Int. Cl.[6] ..... B25C 1/04

[52] U.S. Cl. ..... 227/8; 227/130

[58] Field of Search ..... 227/8, 120, 130

[56] References Cited

U.S. PATENT DOCUMENTS

| | | | |
|---|---|---|---|
| 4,509,668 | 4/1985 | Klaus et al. | 27/8 |
| 4,629,106 | 12/1986 | Howard et al. | 227/8 |
| 5,083,694 | 1/1992 | Lemos | 227/8 |
| 5,137,197 | 8/1992 | Bauer | 227/8 |
| 5,174,485 | 12/1992 | Meyer | 227/8 |
| 5,485,946 | 1/1996 | Jankel | 227/8 |

FOREIGN PATENT DOCUMENTS 118294 12/1984 Japan .

*Primary Examiner*—Scott A. Smith

*Attorney, Agent, or Firm*—Cushman Darby & Cushman IP Group of Pillsbury Madison & Sutro LLP

[57] ABSTRACT

The operation mode of a nailing machine can be automatically and reliably switched, for its selection, from the successive nailing mode and the one-shot nailing mode and vice versa by changing the order of operating a trigger lever and a contact arm. In the selected mode, the nailing work can be performed. By releasing both the trigger lever and the contact arm, the machine is returned to its initial mode. When the contact arm is moved to the top dead center after the trigger lever is operated, a portion of a slide die comes in contact with the underside of the trigger lever. When the trigger lever is operated after the contact arm is moved to the top dead center, the portion of the slide die comes in contact with the upper side of the trigger lever, thereby preventing a further movement of the contact arm to the bottom dead center.

6 Claims, 9 Drawing Sheets

DRIVE DEVICE FOR A NAILING MACHINE

BACKGROUND OF THE INVENTION

1. Field of Invention

The present invention relates to a nailing machine in which a drive valve is operated through the cooperation of the trigger operation of a trigger lever and the operation of pressing the contact arm against a work to which a nail is to be driven.

2. Description of Prior Art

The nailing machine is generally constructed so as to be driven through the cooperation of two manual operations, the trigger operation of the trigger lever and the operation of pressing the contact arm against a work to which a nail is to be driven. The nailing machine operates for nail hitting in two modes, a successive nailing mode and a one-shot nailing mode. In the successive nailing mode, nails are successively driven in a manner that an operator presses the contact arm of the machine against a work to which nails are to be driven (referred to as a "nail receiving member"), while pulling the trigger lever. In the one-shot nailing mode, the two manual operations referred to above are required every nail hitting operation. The nailing machine may be categorized into a nailing machine operable only in the one-shot nailing mode, a nailing machine operable only in the successive nailing mode, and a nailing machine operable selectively in the one-shot nailing mode or the successive nailing mode. An example of the nailing machine operable in both the modes is disclosed in Unexamined Japanese Utility Model Publication No. Hei. 1-18294.

In the nailing machine, the on-position of the drive valve is different from the off-position thereof. In a state that the trigger lever is operated, when the contact arm is returned to the bottom dead center, the trigger valve stem is returned to the bottom dead center or to a position before the off position. This return position of the valve stem is selected by operating a select lever of the trigger lever.

The return position select operation is troublesome in a situation where the nailing work requires a frequent switching of the machine mode between the one-shot nailing mode and the successive nailing mode. In handling the nailing machine, an operator sometimes mistakes the operation of the select lever or an impact is accidentally applied to the nailing machine. In this case, the nailing machine operates an unintended mode. This is very dangerous.

SUMMARY OF THE INVENTION

An object of the present invention is to provide a nailing machine in which the operation mode of the nailing machine can be automatically and reliably switched, for its selection, from the successive nailing mode and the one-shot nailing mode and vice versa by changing the order of operating two operation means, the trigger lever and the contact arm, in the selected mode, the nailing work can be performed, and by releasing both the operation means, the machine is returned to its initial mode (the selected mode is removed).

To achieve the above object, according to one aspect of the invention, there is provided a drive device of a nailing machine for driving a nail hitting mechanism for hitting a nail supplied to a housing, the drive valve being operated through the cooperation of the trigger operation of a trigger lever and the movement of a contact arm toward the top dead center that is performed when the contact arm is pressed against a member to which a nail is to be driven, the drive device having a locking mechanism operating such that the movement of the contact arm to the top dead center and the trigger operation of the trigger lever that follows the movement of the contact arm cooperate to lock the drive valve in an operation state and the drive valve is released from its locked state when the trigger lever is released.

According to second aspect of the invention, in the drive device for a nailing machine, the lock mechanism of the drive device is constructed such that the trigger lever and a slide die that is slidably supported at the top of the contact arm and urged upward are respectively provided with engaging means, the movement of the contact arm to the top dead center and the trigger operation of the trigger lever that follows the movement of the contact arm cooperate to make the engaging means of the slide die contact with the upper part of the engaging means of the trigger lever, thereby preventing a further movement of the contact arm to the bottom dead center, and the engaging means of the slide die detaches from the upper part of the engaging means of the trigger lever when the trigger lever is released.

According third aspect of the invention, in the drive device, the lock mechanism includes an operation link of which the rear end is rotatably supported by the trigger lever and the fore end is positioned above the contact arm, and a cam member that may operate the drive valve and is rotatably supported at the fore end of the operation link. With the lock mechanism thus constructed, the movement of the contact arm to the top dead center and the trigger operation of the trigger lever that follows the movement of the contact arm, cooperate to turn the cam member and to lock the cam member at a position where the drive valve is operable, and the cam member is released from its locked state when the trigger lever is released.

In the drive device according to the first aspect of the present invention, when an operator operates the trigger lever and then presses the contact arm against the nail receiving member to move it toward the top dead center, the nailing machine, like the conventional machine, drives the drive valve through the cooperation of the trigger operation of the trigger lever and the operation of pressing the contact arm against the nail receiving member, thereby driving the nail hitting mechanism. Also when the operator returns the contact arm to its original position while pulling the trigger lever, the drive valve is placed to an off state and returned to its initial state. Accordingly, if the operator repeats the operation of pressing the contact arm against the nail receiving member while pulling the trigger lever, nails can be driven into the member successively. As a matter of course, the drive valve is returned to its initial state by releasing the trigger lever. When the contact arm is first operated and then the trigger lever is operated, the cooperation of those operations drives the nail hitting mechanism. After the nailing operation ends, if the contact arm is detached from the nail receiving member in a state that the trigger lever is pulled, the drive valve is locked by the lock mechanism, and not returned to the initial state. Therefore, if the operator presses the contact arm against the nail receiving member, the nail hitting mechanism is not driven. Thus, the instruction of the successive nailing mode is rejected.

In this case, if the trigger lever is released after the nail hitting operation ends, the locking by the lock mechanism is removed. The drive valve is returned to the initial state. Accordingly, by repeating the same procedural operation, nails can be driven one by one.

The operation mode of the nailing machine can be automatically and reliably switched, for its selection, from the successive nailing mode and the one-shot nailing mode and vice versa by changing the order of operating the trigger lever and the contact arm. The problem that the nailing machine is driven in the unintended mode is solved. In a state that both the members are released, the operation mode is removed irrespective of the type of the mode. The nailing work can be performed efficiently.

In the drive device, according the second aspect of the invention, the movement of the contact arm to the top dead center and the trigger operation of the trigger lever that follows the movement of the contact arm cooperate to drive the nail hitting mechanism. At this time, the engaging means of the slide die is in contact with the upper part of the engaging means of the trigger lever. Therefore, after the nailing operation ends, if the operator detaches the contact arm from the nail receiving member while pulling the trigger lever, thereby moving the contact arm downward, the engaging means of the trigger lever is brought into contact with the engaging means of the slide die. Therefore, a further movement of the contact arm to the bottom dead center is prevented, and the drive valve is not placed to the off state. If the contact arm is pressed against the nail receiving member again, the drive mechanism is not driven, and hence it is impossible to successively drive nails to the nail receiving member.

In this case, if the trigger lever is released after the nailing operation ends, the engaging means disengages from each other. The contact arm is moved to the bottom dead center, and the drive valve is placed to the off state and returned to the initial state. Accordingly, by repeating the same procedural operations, the machine is operated in the one-shot nailing mode.

In the drive device, according to the third aspect of the invention, the movement of the contact arm to the top dead center and the trigger operation of the trigger lever that follows the movement of the contact arm, cooperate to turn the cam member, to place the drive valve to the on state, and to drive the nail hitting mechanism. After the nailing operation ends, if the operator detaches the contact arm from the nail receiving member while pulling the trigger lever, it is not returned to its initial state since the cam member sets the drive valve in a operable state. Accordingly, if the contact arm is pressed against the nail receiving member again, the drive mechanism is not driven, and hence it is impossible to successively drive nails to the nail receiving member.

In this case, by releasing the trigger lever after the nailing operation ends, the rocking by the cam member is removed, and the drive valve is returned to its initial state. Accordingly, by repeating the same procedural operations, the machine is operated in the one-shot nailing mode.

DETAILED DESCRIPTION OF THE PREFERRED EMBODIMENTS

Figure 1:
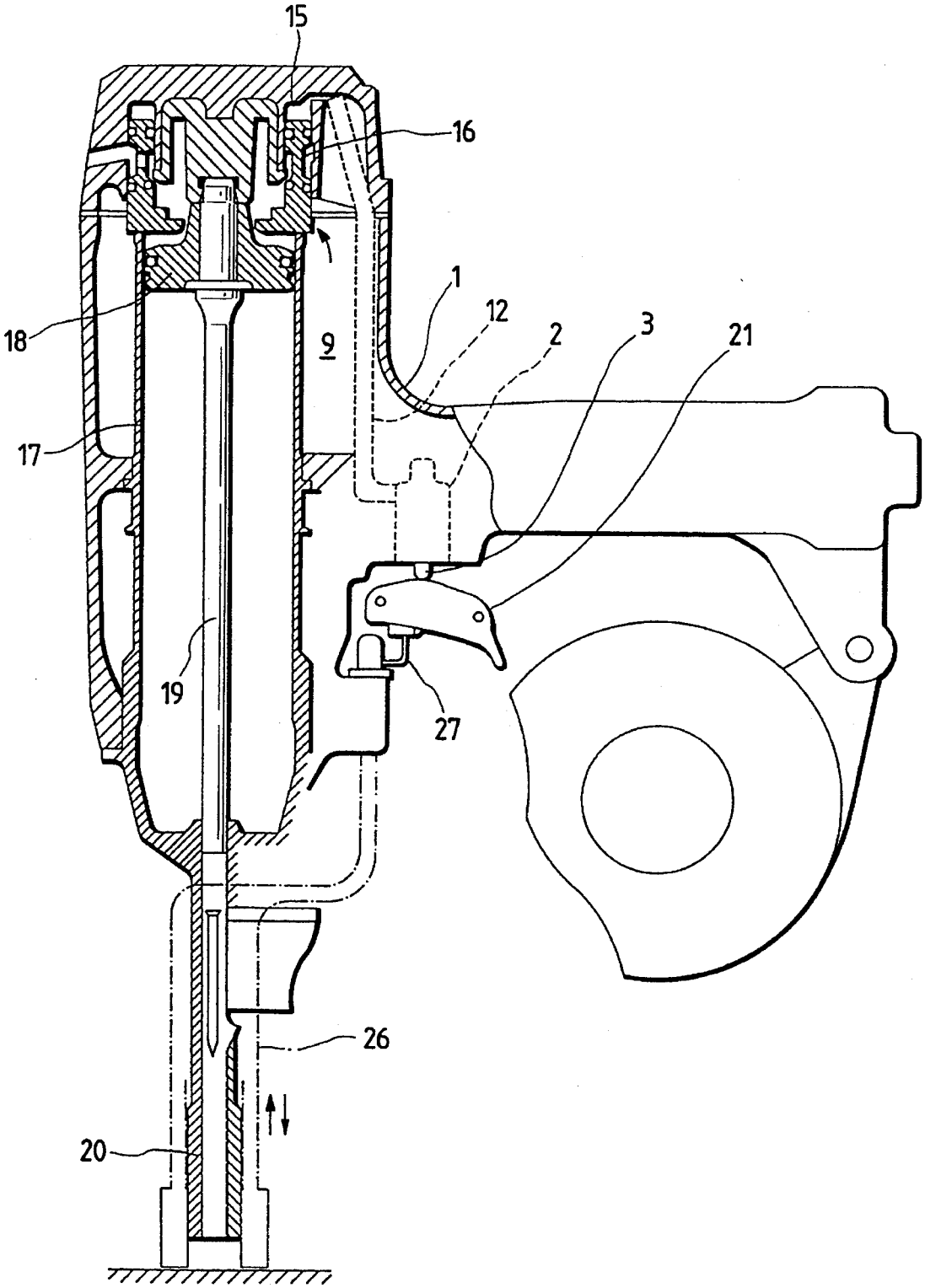
FIG. 1 is a sectional view showing a nail hitting mechanism of a nailing machine and a drive device for the nailing machine according to an embodiment of the present invention.
Figure 2A:
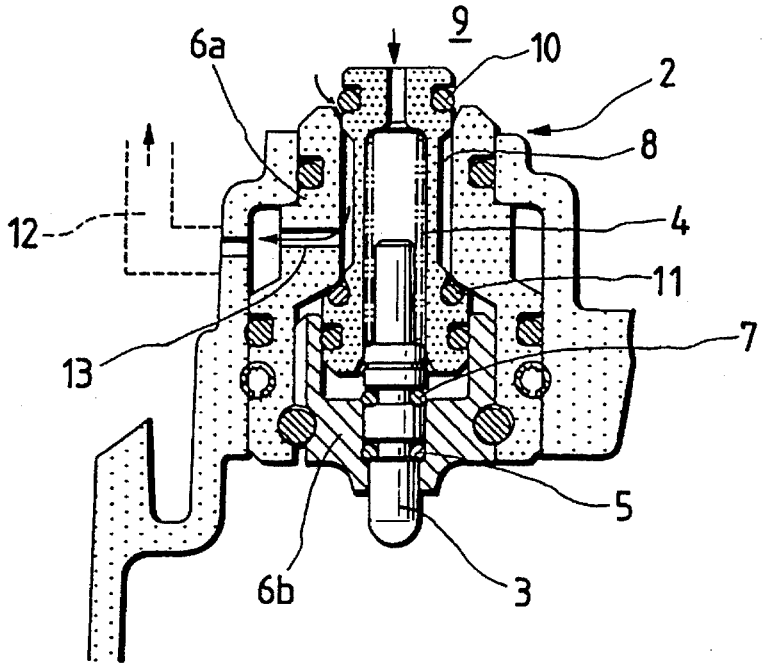
FIGS. 2A and 2B are cross sectional views for explaining the operation of a drive valve.
Figure 2B:
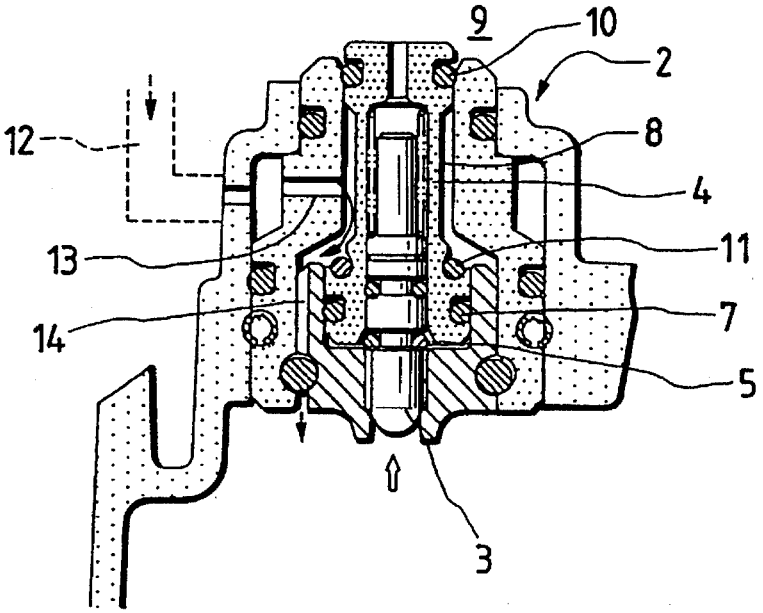
Figure 3:
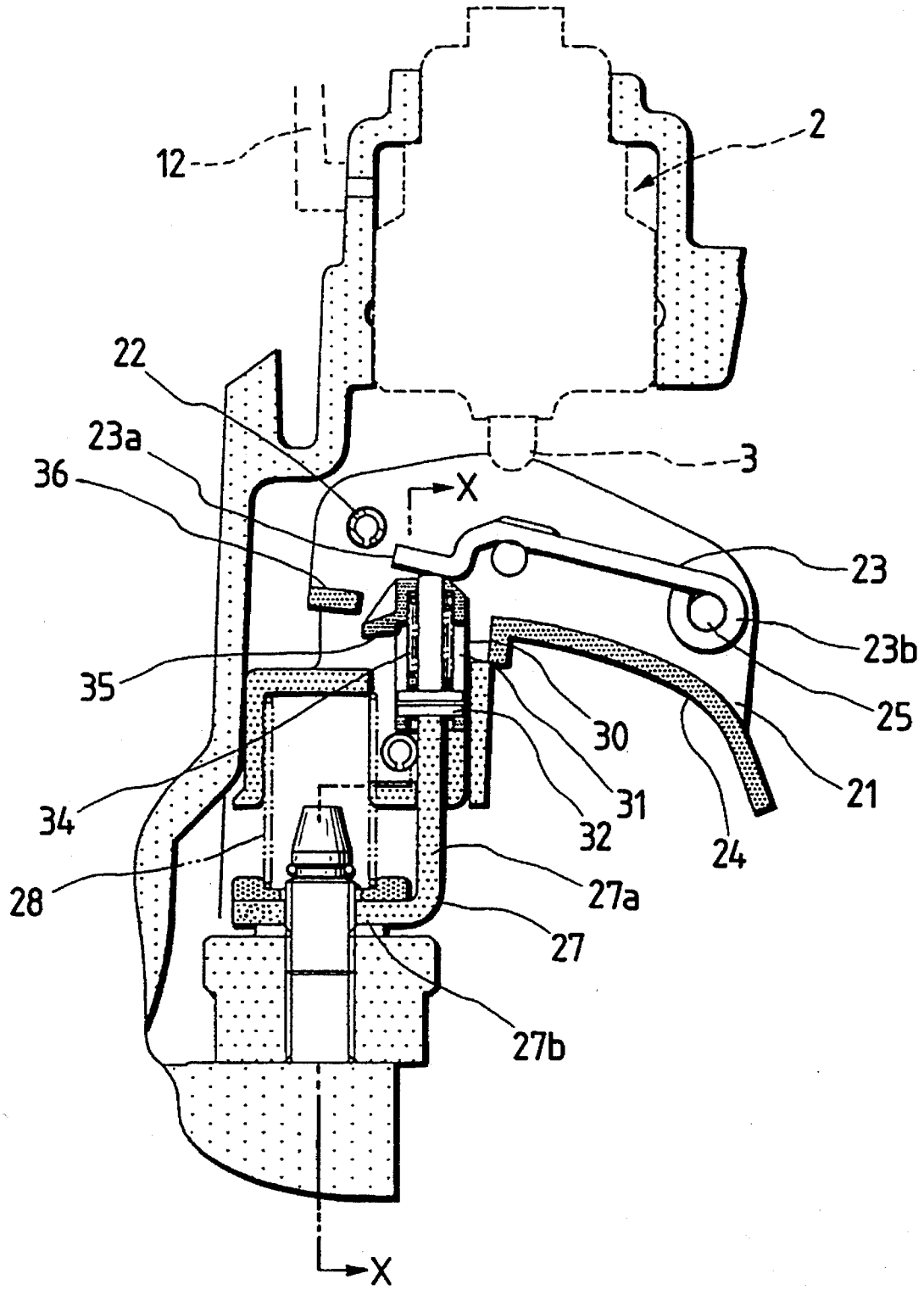
FIG. 3 is an enlarged, cross sectional view showing a key portion of the drive device.
Figure 4:
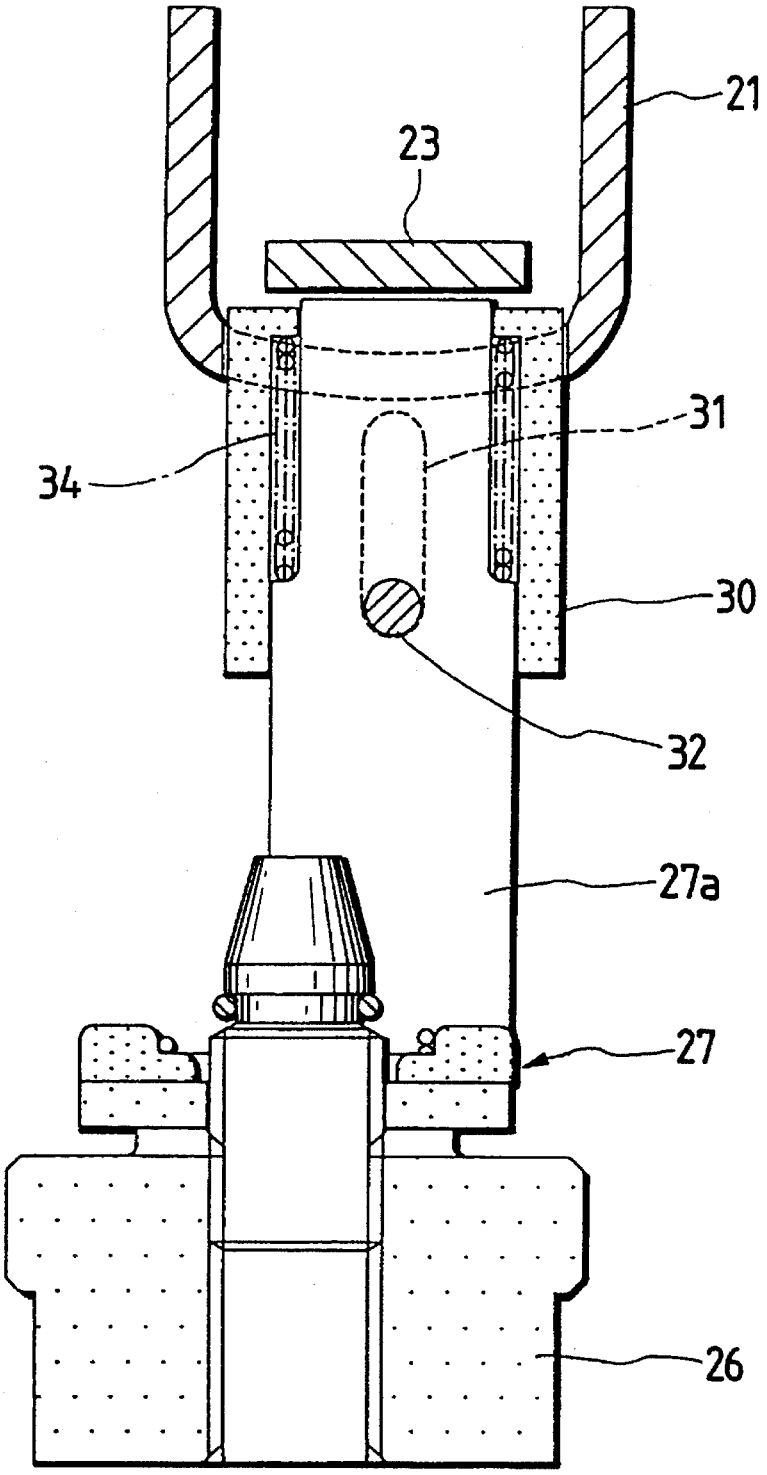
FIG. 4 is a cross sectional view taken on line X—X in FIG. 3.
Figure 5A:
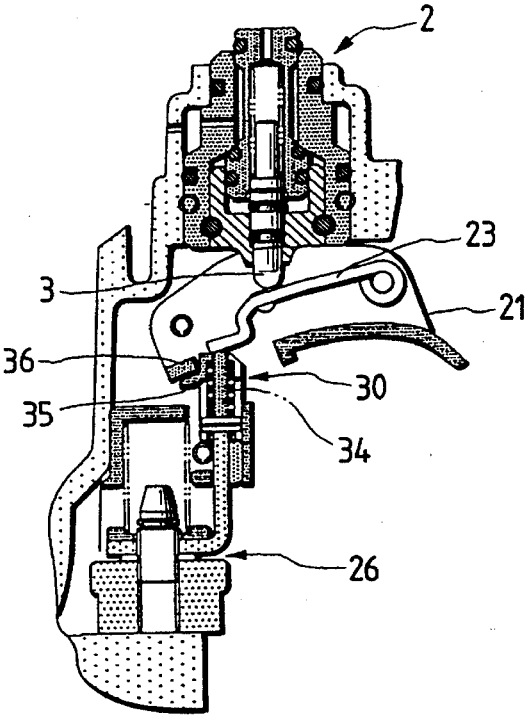
FIGS. 5A to 5C are cross sectional views for explaining the operation of the drive device when the nailing machine is in a successive nailing mode.
Figure 5B:
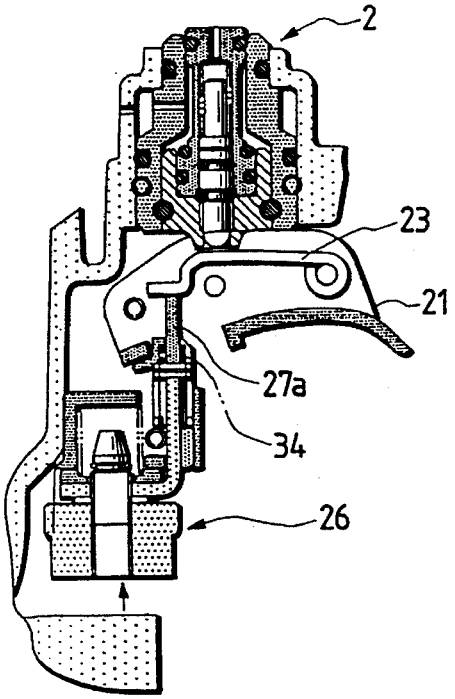
Figure 5C:
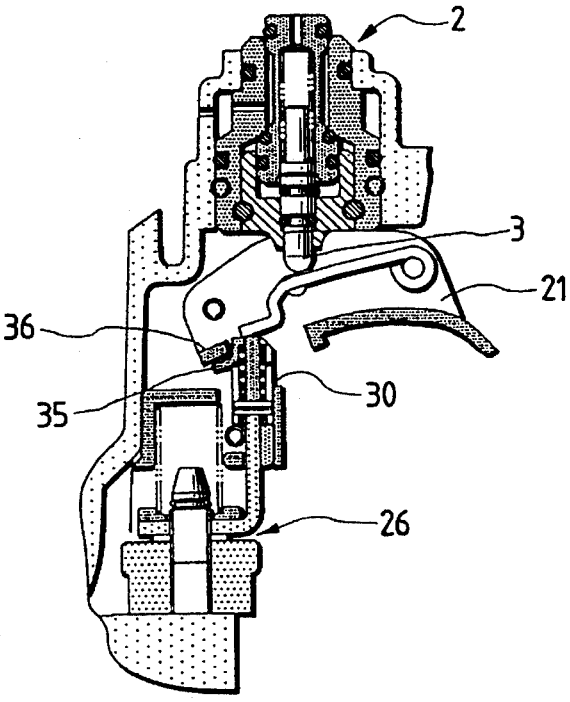
Figure 6A:
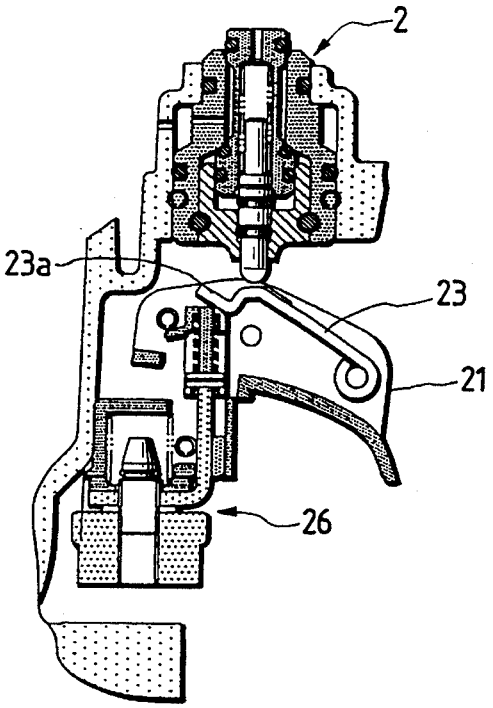
FIGS. 6A to 6C are cross sectional views for explaining the operation of the drive device when the nailing machine is in a one-shot nailing mode.
Figure 6B:
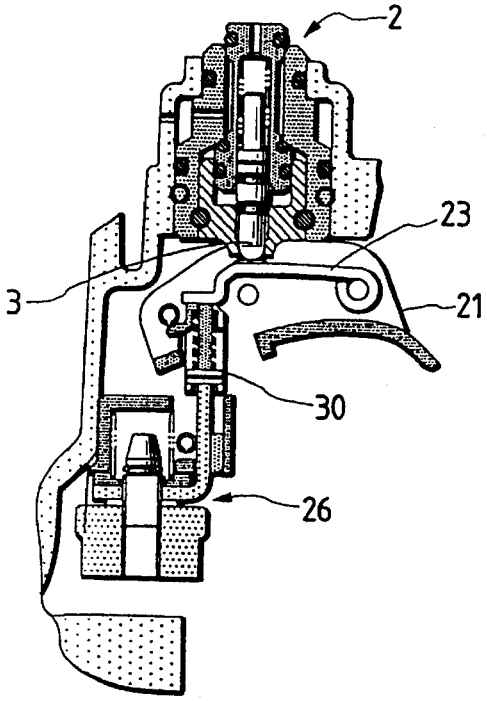
Figure 6C:
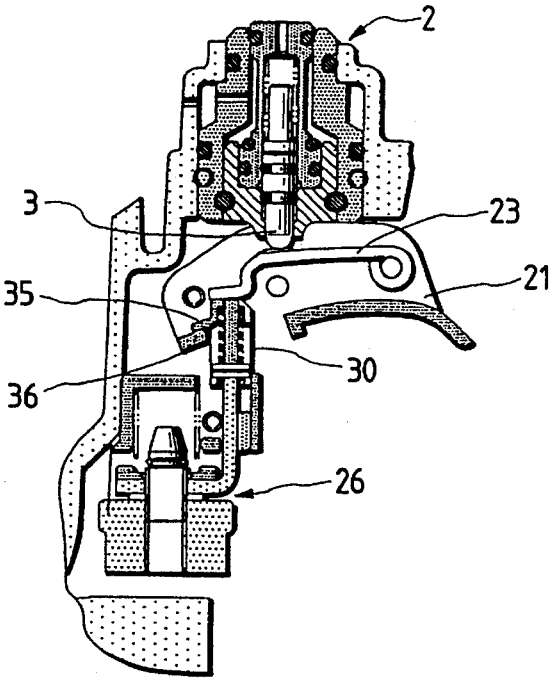

FIG. 1 is a sectional view showing a nail hitting mechanism of a nailing machine and a drive device for the nailing machine according to an embodiment of the present invention. FIGS. 2A and 2B are cross sectional views for explaining the operation of a drive valve. FIG. 3 is an enlarged, cross sectional view showing the drive device. FIG. 4 is a cross sectional view taken on line X—X in FIG. 3. FIGS. 5A to 5C are cross sectional views for explaining the operation of the drive device when the nailing machine is in a successive nailing mode. FIGS. 6A to 6C are cross sectional views for explaining the operation of the drive device when the nailing machine is in a one-shot nailing mode.

In those views, a housing 1 of a nailing machine contains a nail hitting mechanism and a drive valve for driving the nail hitting mechanism. Those are the same as those disclosed in Unexamined Japanese Utility Model Publication No. Hei. 1-18294. Hence, those will be described briefly. As shown in FIGS. 2A and 2B, when a trigger valve stem 3 of a drive valve 2 is pushed upward (by a contact lever 23) while resisting a spring 4 and reaches a top dead center, an exhaust valve 5 is opened to make the inside of a large diameter valve cylinder *6a* communicate with the air. At the same time, an air supply valve 7 cooperates with a pilot valve 8 to shut off the introduction of compressed air into the valve cylinder *6a*. As a result, the compressed air in the valve cylinder *6a* is expelled out of a space around the trigger valve stem 3. The pilot valve 8 is moved from a first position (top dead center) to a second position (bottom dead center) by the compressed air in an air chamber 9. With the movement, a first pilot valve body 10 of the pilot valve 8 interrupts the connection of the air chamber 9 and the large diameter valve cylinder *6a*, while at the same time a second pilot valve body 11 makes a path 12 and an opening 13 communicate with an exhaust path 14. Accordingly, the compressed air in a chamber 15 above the main valve of the nail hitting mechanism is forced to be discharged into the air. As a result, a main valve 16 is moved to an open position by the compressed air in the air chamber 9 located under the main valve per se. By the movement to the opening position, a hitting cylinder 17 is disconnected from the air while communicates with the air chamber 9. The compressed air flows into the hitting cylinder 17, thereby driving a hitting piston 18 and a driver 19. The driver hits a nail in an ejection part 20 located at the tip top of the housing 1, and ejects it from the ejection part.

When the pushing force acting on the trigger valve stem 3 is removed, it is returned from the top dead center to the bottom dead center by the spring 4. The exhaust valve 5 is closed again to shut off a small diameter cylinder valve *6b* from the air. At the same time, the air supply valve 7 is opened and cooperates with the pilot valve 8 to allow the compressed air to flow from the air chamber 9 to the small diameter cylinder valve 6*b*. Accordingly, the pilot valve 8 is moved to the first position. The first pilot valve body 10 spaces apart the air chamber 9 from the small diameter cylinder valve 6*b*. The second pilot valve body 11 shuts off the path 12 and the opening 13 from the exhaust path 14. The compressed air is supplied to the chamber 15. The main valve 16 is moved again to the closed position. As a result, the hitting cylinder 17 is opened to the air, and the compressed air is exhausted. The hitting piston 18 is returned to the top dead center by a returning mechanism, not shown. The nail hitting mechanism is set to an initial state again.

Thus, when the trigger valve stem 3 is pushed upward to the top dead center, the nail hitting mechanism is driven. When it is returned to the bottom dead center, the nail hitting mechanism is returned to its initial state.

The bottom end of the trigger valve stem 3 is protruded below the large diameter valve cylinder 6*a*. A trigger lever 21 is attached to the housing 1 such that it is located just under the bottom end of the trigger valve stem. The trigger lever 21, shaped like U in cross section, is pivotally supported at one end thereof by a pivot 22 provided on the housing 1. A contact lever 23 is disposed between both side walls of the trigger lever 21. One end 23*a* of the contact lever 23 is extended toward the pivot 22 of the trigger lever 21. The other end 23*b* thereof is rotatably supported by a rotary shaft 25 located between the side walls of the trigger lever 21 and close to a finger receiving portion 24 of the trigger lever 21. The turning of the contact lever 23 is limited by a stopper 29.

A contact arm 26, extended in the direction of the prolongation of the driver 19 under the bottom of the housing 1, is vertically movably disposed around the ejection part 20 supplied with nails. The lower end of the contact arm 26 is extendable downward beyond the bottom end of the ejection part 20. As shown in FIGS. 3 and 4, an L-shaped member 27 is fastened to the top of the contact arm 26. A vertical part 27*a* of the L-shaped member 27 stands upward under the first end 23*a* of the contact lever 23. A spring 28 is disposed between a horizontal part 27*b* of the L-shaped member 27 and the housing 1. With this structure, the contact arm 26 is constantly urged, by means of the spring 28, downward so that the bottom end thereof is protruded downward from the bottom of the housing 1. When the bottom of the contact arm 26 is pushed against a member to which nails are to be driven, viz., a nail receiving member (as already defined), the contact arm 26 is moved toward the top dead center while resisting the spring 28.

A slide die 30 is slidably supported on the vertical part 27*a* of the L-shaped member 27 on the top end of the contact arm 26. The slide die 30, shaped like a tube, has a pair of guide holes 31 formed in the opposite side walls thereof. The slide die 30 slidably receives the contact arm 26. A pin 32 is provided on the tip top of the contact arm 26. The pin 32 is slidably inserted into the guide holes 31 of the slide die. In the slide die 30, the pin 32 is in contact with a compressed spring 34 and urged upward by the compressed spring 34.

The slide die 30 and the trigger lever 21 are respectively provided with engaging means that are disposed such that they may engage with each other. To be more specific, a protruded part 35 is protruded from the side wall of the slide die 30, which is closer to the pivot 22 of the trigger lever 21. A cogging part 36 is protruded toward the protruded part 35 of the slide die 30, from the side wall of the trigger lever 21, which includes the pivot 22 formed thereon. When the trigger lever 21 is turned, the protruded part 35 of the slide die 30 comes in contact with the cogging part 36 of the trigger lever 21 in a one-on-the-other fashion. With provision of those engaging means, as will be described later, a lock mechanism is formed, which functions such that when the trigger lever 21 is operated after the contact arm 26 is moved to the top dead center, the contact arm 26 is locked so as not to move toward the bottom dead center. When the trigger lever 21 is released, the contact arm 26 is released from its locked state.

The operation of the thus constructed nailing machine will be described. Description will be given on the successive nailing mode and the one-shot nailing mode. In the construction of the nailing machine, such an operation of the contact lever 23 that it pushes upward the trigger valve stem 3 to place the drive valve 2 to an on state is allowed only when the turning of the trigger lever 21 based on the manual operation and the pressing of the contact arm 26 against the nail receiving member is driven are cooperatively performed.

To set up the successive nailing mode, an operator operates the trigger lever 21, and then presses the contact arm 26 against the nail receiving member till it is moved up to the top dead center. At this time, as shown in FIG. 5A, the protruded part 35 of the slide die 30 is in contact with the lower face of the cogging part 36 of the trigger lever 21, whereby the upward movement of the slide die 30 is prevented. Under this condition, the upper end of the contact arm 26 moves upward while resisting the compressed spring 34 of the slide die 30 (FIG. 5B). The contact lever 23 is moved upward to push the trigger valve stem 3 to turn on the drive valve 2, as referred to above. By the main valve 16, the nail hitting mechanism hammers a nail into the nail receiving member.

After the nailing operation ends, the contact arm 26 is returned to its original position in a state that the trigger lever 21 is left in the pulled-state. Then, the protruded part 35 of the slide die 30 is disengaged from the cogging part 36 of the trigger lever 21 as shown in FIG. 5C. At the same time, the contact lever 23 is turned up to its bottom dead center. In turn, the trigger valve stem 3 is returned from the top dead center to the bottom dead center. The drive valve 2 is placed to an off state. In this state, the contact arm 26 is pressed against the nail receiving member. Then, the contact lever 23 is pushed up, and the trigger valve stem 3 is pushed up to its top dead center. In turn, the drive valve 2 is placed to the on state again.

When in this way, the operator repeats alternately the pressing of the contact arm 26 against the nail receiving member and the releasing it from its pressed state, the drive valve 2 is placed to the on and off states alternately and the nail hitting mechanism is successively driven. Accordingly, the nails can be driven into the nail receiving member in successive manner.

After the nailing operation ends, the trigger lever 21 is released, the drive valve 2 is placed to the off state. The nail hitting mechanism is returned to its initial state shown in FIG. 3.

To set up the one-shot nailing mode, the operator presses the nailing machine against the nail receiving member to move the contact arm 26 upward, as shown in FIG. 6A. The contact arm 26 pushes, by its top, upward the end 23*a* of the contact lever 23. Thereafter, the operator pulls the trigger lever 21, to turn the contact lever 23 as shown in FIG. 6B. The trigger valve stem 3 is pushed upward. The drive valve 2 is set to the on state, the nail hitting mechanism is driven, and the nailing operation is performed.

After the nailing operation ends, the operator detaches the contact arm 26 from the nail receiving member while pulling the trigger lever 21 with his finger. At this time, the contact arm 26 will move to its original position. However, the protruded part 35 of the slide die 30 comes in contact with the upper face of the cogging part 36. As a result, a further movement of the contact arm 26 to the bottom dead center is prevented (FIG. 6C). Therefore, the contact lever 23 cannot also be returned to its initial position. The valve stem moves back from the top dead center and stops before it reaches the second position. In this state, the drive valve 2 is not set to the off state, and the main valve 16 is also left in the on state. Consequently, the nail hitting mechanism cannot return to its initial state. Under this condition, if the contact arm 26 is pushed against the nail receiving member, the nail hitting mechanism is not driven. In other words, the successive nailing operation is impossible.

When the trigger lever 21 is released from this state, the protruded part 35 of the slide die 30 disengages from the cogging part 36 of the trigger lever 21, thereby releasing the contact arm from its locked state. The contact lever 23 is released to turn further downward, and the trigger valve stem 3 also moves further downward. The drive valve 2 is set to the off state as referred to above. The nail hitting mechanism is returned to its initial state shown in FIG. 3. Accordingly, nails can be driven in one-shot nailing manner by repeating the same procedural operations.

As seen from the foregoing description, in either of the two modes, the main valve is returned to its initial state by releasing the trigger lever 21. Therefore, at this time, the operator may select the successive nailing mode or the one-shot nailing mode.

In the above-mentioned embodiment, the lock mechanism of the contact arm 26 which operates responsive to the operation of the trigger lever 21 performed after the contact arm 26 reaches the top dead center, is constructed on the basis of the engagement/disengagement of the cogging part 36 of the trigger lever 21 and the protruded part 35 of the contact arm 26. However, the lock mechanism may be constructed in any other suitable way.

Figure 7:
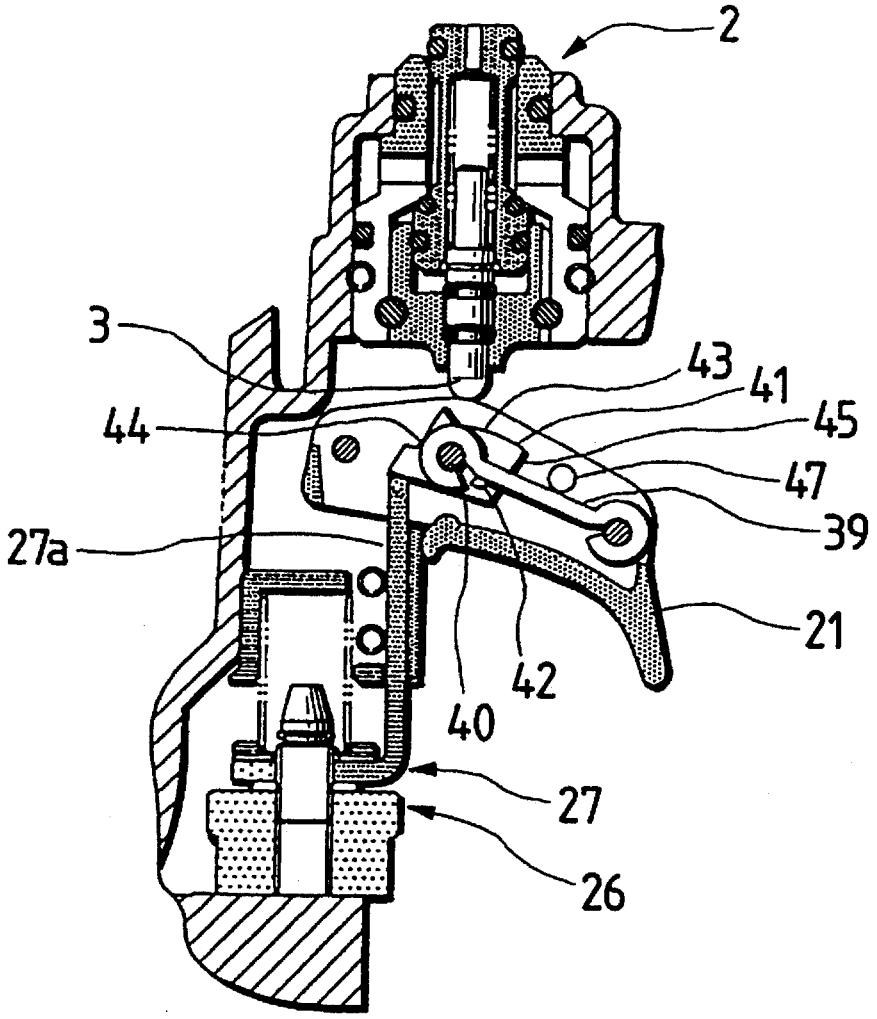
FIG. 7 is a cross sectional view showing another drive device.

FIG. 7 shows another embodiment of a drive device with another lock mechanism. In this lock mechanism, an operation link 39 is provided. The rear end of the operation link 39 is rotatably supported by a support shaft 38, located at the rear end of the trigger lever 21. The fore end of the operation link 39 is positioned above the vertical part 27*a* of the L-shaped member 27 (not including the slide die 30) provided at the top of the contact arm 26. A cam member 41 that may operate the drive valve 2 is supported by a shaft 40 for the fore end of the operation link 39. The movement of the contact arm 26 to the top dead center and the trigger operation of the trigger lever 21 cooperate to turn the cam member 41 and to lock it to a position where the drive valve 2 is operable. The cam member 41 is released from its locked state when the trigger lever 21 is released.

A stopper 47 provided on the side wall of the trigger lever 21 stops the clockwise turn of the operation link 39.

A torsion coiled spring (not shown), provided between the cam member 41 and the operation link 39, urges the cam member 41 to turn counterclockwise. A stopper pin 42, erected on the side face of the cam member 41, stops a further turn of the cam member 41 when it comes in contact with the operation link 39. A first pushing part 43 and a second pushing part 44 are formed on the circumferential edge face of the cam member 41. When coming in contact with the bottom end of the trigger valve stem 3 of the drive valve 2, these pushing parts push the trigger valve stem 3 upward. The cam member 41 includes an end face 45 opposed to the second pushing part 44 (closer to the stopper pin 42). When the second pushing part 44 of the cam member 41 pushes the trigger valve stem 3, the end face 45 of the cam member 41 engages the front upper face of the coupling portion (finger receiving portion) 24 that couples both side walls of the trigger lever 21.

With this construction of the drive device, in an initial state, the lower face of the fore end of the cam member 41 is in contact with the top of the contact arm 26. The cam member 41 is turned counterclockwise by the torsion coiled spring, so that the stopper pin 42 engages the operation link 39. The operation link 39 is supported by the contact arm 26, with the cam member 41 intervening therebetween. The operation link 39 is turned till the mid part thereof is located close to the stopper pin 42. In this state, the first pushing part 43 of the cam member 41 faces the trigger valve stem 3.

Figure 8A:
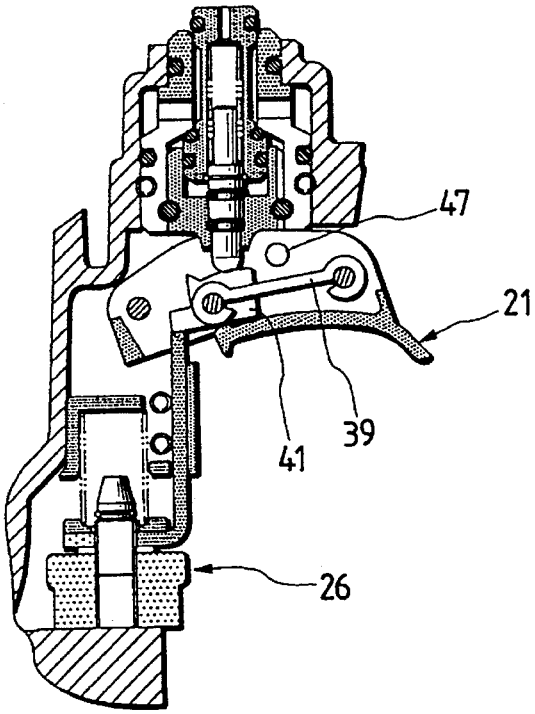
FIGS. 8A to 8C are cross sectional views for explaining the operation of the drive device when the nailing machine is in a successive nailing mode.

To select the successive nailing mode, an operator operates the trigger lever 21, and then the contact arm 26. When he pulls the trigger lever 21, the rear end of the trigger lever 21 moves upward and the rear end of the operation link 39 also moves upward (FIG. 8A). The cam member 41, supported by the operation link 39, is left supported by the front end of the contact arm 26. Then, the operation link 39 is turned about the front end of the contact arm 26. The first pushing part 43 of the cam member 41 moves while being in contact with the bottom end of the trigger valve stem 3.

Figure 8B:
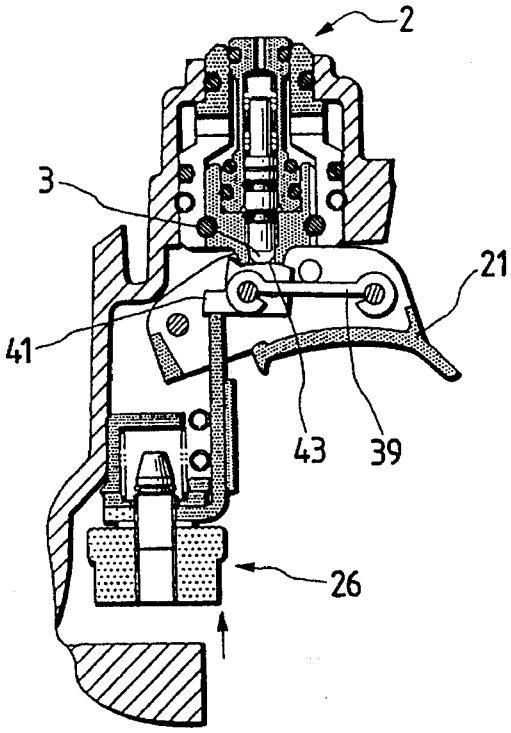
Figure 8C:
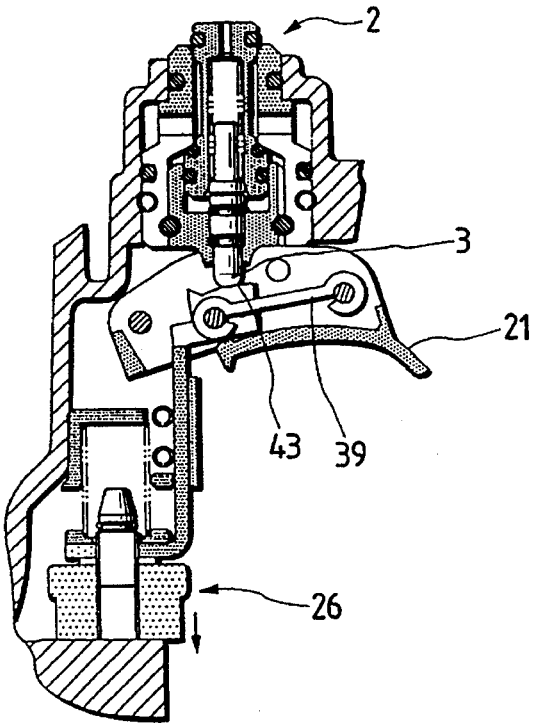

In this state, when the contact arm 26 is operated, the top of the contact arm 26 is moved upward to push the cam member 41 upward, as shown in FIG. 8B. Because of the torsion coiled spring between the cam member 41 and the operation link 39, the operation link 39 is turned with the upward movement of the cam member 41, so that the fore end of the cam member 41 is moved upward. As a result, the first pushing part 43 of the cam member 41 pushes the trigger valve stem 3 to drive the drive valve 2, and the nailing machine is driven.

When the operator releases the contact arm 26 while pulling the trigger lever 21, the operation link 39 turns with the downward movement of the contact arm 26, the cam member 41 moves downward, the trigger valve stem 3 is returned to its original position, and the drive valve 2 is returned to its original state.

When the contact arm 26 is operated again, the cam member 41 moves upward as in the previous case. The trigger valve stem 3 is pushed upward again, the drive valve 2 is set to the on state, and the nailing machine is driven. Thus, so long as the trigger lever 21 is pulled, the nailing machine can be successively operated by merely repeating the operation of the contact arm 26.

Figure 9A:
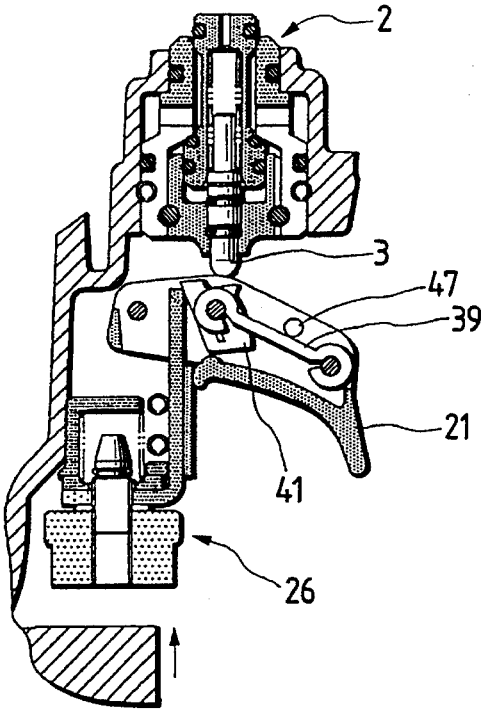
FIGS. 9A to 9C are cross sectional views for explaining the operation of the drive device when nailing machine is in a one-shot nailing mode.

To select the one-shot nailing mode, the operator pushes the nailing machine against a member to which a nail is to be driven, and then pulls the trigger lever 21. When the contact arm 26 that is in its initial state is operated, the fore end part of the cam member 41 is pushed upward with the upward movement of the top of the contact arm 26 (FIG. 9A). The operation link 39 will turn clockwise. At this time, the mid part of the operation link 39 engages the stopper pin 42, thereby blocking the turn of the operation link 39, however. The cam member 41 is turned clockwise while resisting the torsion coiled spring till the second pushing part 44 faces the trigger valve stem 3.

Figure 9B:
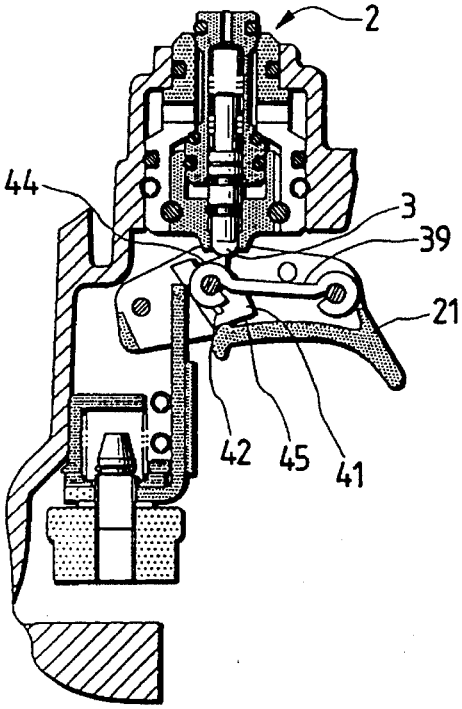
Figure 9C:
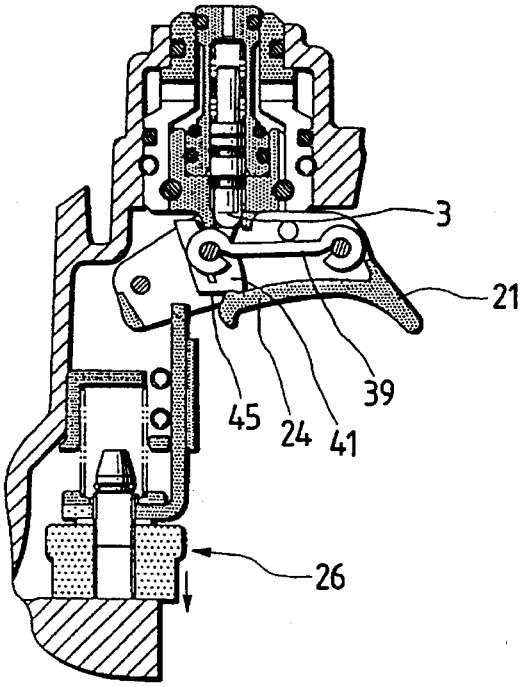

Then, the trigger lever 21 is pulled. In turn, the end face 45 of the cam member 41, which is located close to the stopper pin 42, comes in contact with the upper face of the coupling portion 24 (FIG. 9B). In this state, the cam member 41 is moved upward with the turn of the trigger lever 21 (FIG. 9C). The second pushing part 44 of the cam member 41 pushes the trigger valve stem 3 to operate the drive valve 2, and the nailing machine is driven.

If the operator releases the contact arm 26 while pulling the trigger lever 21, the drive valve 2 is not returned to its initial state. The reason for this follows. In this state, the cam member 41 is nipped between the upper face of the trigger lever 21 and the housing of the drive valve 2, so that it cannot be turned and moved downward, viz., it is locked. Accordingly, the trigger valve stem 3 is locked at the position where the drive valve 2 is operable, while being pushed. Therefore, if the contact arm 26 is operated, the nailing machine is not driven.

When the trigger lever 21 is released, it is moved downward, the cam member 41 is released from its locked state, and the drive valve 2 is returned to the initial state. The cam member 41 is turned by the torsion coiled spring to return to its initial state (where the first pushing part 43 of the cam member 41 faces the trigger valve stem 3). Thus, the one-shot nailing operation is performed by repeating the procedural operations mentioned above.

As described above, also in this case, the operation mode of the nailing machine can be easily and reliably switched, for its selection, from the successive nailing mode and the one-shot nailing mode and vice versa by changing the order of operating the trigger lever 21 and the contact arm 26. Therefore, the nailing machine is never operated in an unintended mode. In a state that both the members are released, the operation mode is removed irrespective of the type of the mode. The nailing work can be performed efficiently.

While in the above-mentioned embodiment, the cam member 41 includes the first pushing part 43. However, the operation link 39 may include the first pushing part formed integral therewith.

What is claimed is:

1. A drive device for a nailing machine for driving a nail to a work, said drive device comprising:

a nail hitting mechanism for hitting the nail;

a drive valve for driving said nail hitting mechanism;

a contact arm for pressing against the work, said contact arm being reciprocally movable between a bottom dead center position and a top dead center position;

a trigger lever, operation of said trigger lever cooperating with a movement of said contact arm to top dead center to operate said drive valve; and a locking mechanism for locking said drive valve in an operative disposition when said trigger lever is operated after said contact arm is moved to the top dead center position, whereby successive nail driving is precluded and said locking mechanism releasing said drive valve from said operative disposition when said trigger lever is released from operation.

2. A drive device according to claim 1, wherein said lock mechanism includes:

a slide die slidably supported at a top end of the contact arm and urged upwardly;

first engaging means provided on said slide die; and second engaging means provided on said trigger lever, said second engaging means selectively engaging said first engaging means such that movement of said contact arm to top dead center and a trigger operation of said trigger lever following the movement of the contact arm cooperate to make said first engaging means of said slide die contact with a upper part of said second engaging means of said trigger lever, thereby preventing a further movement of said contact arm to bottom dead center, and said first engaging means of said slide die detaching from the upper part of said second engaging means of said trigger lever when said trigger lever is released.

3. A drive device for according to claim 1, wherein the lock mechanism includes:

an operation link of which a rear end is rotatably supported by said trigger lever and a fore end is positioned above said contact arm; and a cam member rotatably supported at the fore end of said operation link, said cam member operating said drive valve such that movement of said contact arm to top dead center and a trigger operation of said trigger lever following said movement of said contact arm, cooperate to turn said cam member and to lock said cam member at a position where said drive valve is operable, and said cam member is released from its locked state when said trigger lever is released.

4. An improved drive device of a nailing machine for driving a nail hitting mechanism for hitting a nail supplied to a housing, a drive valve being operated through cooperation of a trigger operation of a trigger lever and movement of a contact arm toward a top dead center position thereof that is performed when a contact arm is pressed against a member to which a nail is to be driven, the improvement which comprises a locking mechanism operating such that movement of the contact arm to top dead center and trigger operation of the trigger lever following said movement of the contact arm cooperating to lock the drive valve in an operation state whereby successive nail driving is precluded and the drive valve is released from its locked state when the trigger lever is released.

5. A drive device for a nailing machine according to claim 4, wherein said lock mechanism is constructed such that the trigger lever and a slide die that is slidably supported at a top of the contact arm and urged upward are respectively provided with engaging means, movement of the contact arm to top dead center and trigger operation of the trigger lever following the movement of the contact arm cooperating to make the engaging means of the slide die contact with an upper part of the engaging means of the trigger lever, thereby preventing a further movement of the contact arm to a bottom dead center, and the engaging means of the slide die detaches from the upper part of the engaging means of the trigger lever when the trigger lever is released.

6. A drive device for a nailing machine according to claim 4, wherein said lock mechanism includes an operation link of which a rear end is rotatably supported by the trigger lever and a fore end is positioned above the contact arm, and a cam member that selectively operates the drive valve and is rotatably supported at the fore end of said operation link, whereby movement of the contact arm to the top dead center and trigger operation of the trigger lever following said movement of the contact arm, cooperate to turn the cam member and to lock the cam member at a position where the drive valve is operable, and the cam member is released from its locked state when the trigger lever is released.

* * * * *